US006394197B1

(12) United States Patent
Holte

(10) Patent No.: US 6,394,197 B1
(45) **Date of Patent: *May 28, 2002**

(54) REVERSE CIRCULATION DRILLING SYSTEM WITH BIT LOCKED UNDERREAMER ARMS

(76) Inventor: Ardis L. Holte, 181 Polk St., Eugene, OR (US) 97402

( * ) Notice: Subject to any disclaimer, the term of this patent is extended or adjusted under 35 U.S.C. 154(b) by 0 days.

This patent is subject to a terminal disclaimer.

(21) Appl. No.: 09/702,277

(22) Filed: Oct. 30, 2000

Related U.S. Application Data

(63) Continuation-in-part of application No. 09/122,616, filed on Jul. 24, 1998, now Pat. No. 6,209,665.

(51) Int. Cl.[7] ..... E21B 10/66
(52) U.S. Cl. ..... 175/273; 175/286; 175/389
(58) Field of Search ..... 175/265, 273, 175/286, 292, 295, 389

(56) References Cited

U.S. PATENT DOCUMENTS

| | | | | |
|---|---|---|---|---|
| 5,052,503 A | | 10/1991 | Lof | 175/258 |
| 5,139,099 A | | 8/1992 | Hayashi et al. | 175/292 |
| 5,186,265 A | | 2/1993 | Henson et al. | 175/107 |
| 5,511,628 A | | 4/1996 | Holte | 175/296 |
| 5,787,999 A | | 8/1998 | Holte | 175/273 |
| 6,209,665 B1 | * | 4/2001 | Holte | 175/273 |

* cited by examiner

*Primary Examiner*—William Neuder
(74) *Attorney, Agent, or Firm*—Glenn C. Brown

(57) ABSTRACT

A underreamer drill bit assembly including a pilot bit and extendable underreaming arms operatively connected to the pilot bit. The underreaming arms have an extended position for underreaming, and a retracted position in which the overall diameter of the underreamer drill bit assembly is less than the inside diameter of the well casing, permitting the entire bit assembly to be withdrawn through the well casing. In another aspect of the invention, the bit assembly is operatively connected to a dual wall pipe assembly. A supply of compressed air is conducted through the annulus of the dual wall pipe assembly to a down hole pneumatic hammer. Exhaust air from the down hole hammer is directed to the bit assembly for continuous removal of drilling debris through a central evacuation tube of the dual wall pipe assembly. In another aspect of the invention, a pressurized, incompressible fluid is injected into the annulus between the well casing and the downhole pneumatic hammer.

12 Claims, 14 Drawing Sheets

Fig. 17
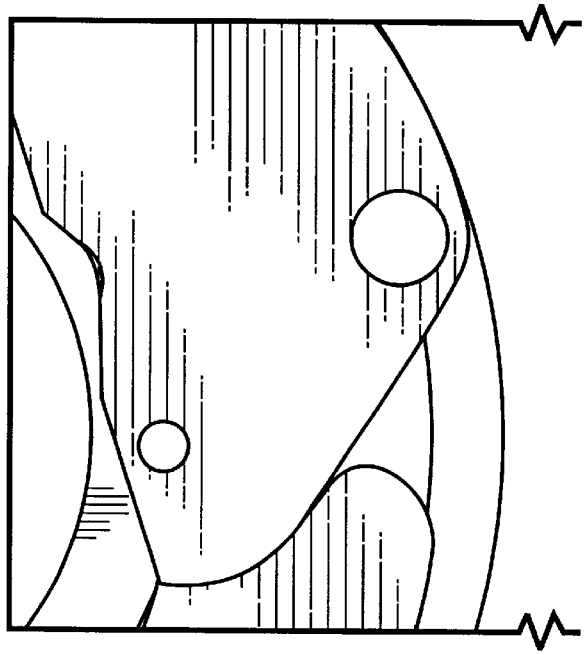
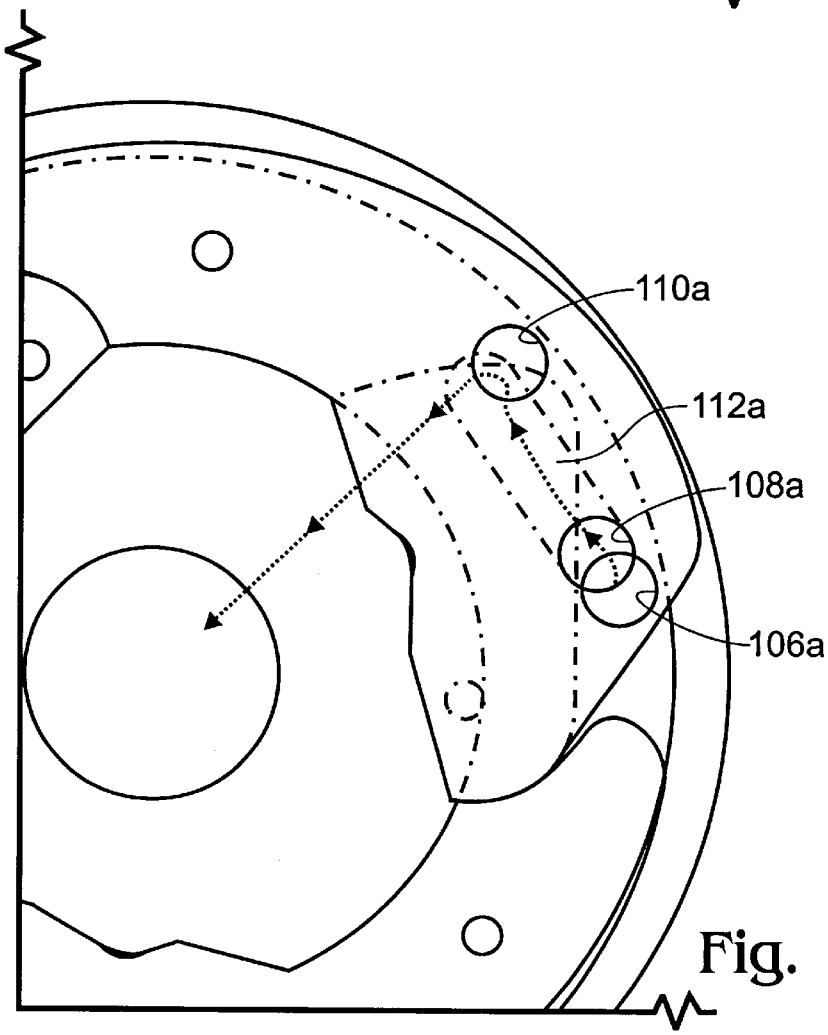
Fig. 18

REVERSE CIRCULATION DRILLING SYSTEM WITH BIT LOCKED UNDERREAMER ARMS

This application is a continuation-in-part of 09/122,610, filed Jul. 24, 1998 now in 6,209,665.

BACKGROUND OF THE INVENTION

The present invention is related to earth drilling equipment, and particularly to down hole, pneumatic, percussive hammer drilling systems. As noted in my related co-pending applications, Ser. No. 08/674,123, filed Jul. 1, 1996, and Ser. No. 09/122,616, filed Jul. 24, 1998, to which the present application is a continuation-in-part, underreamers are used for the formation of radially enlarged areas extending about a pilot bit for insertion of a casing.

Eccentrically mounted underreamers are known which include an arm which travels in an orbit for underreaming operation, and which are retractable toward the hole axis for tool removal purposes. However, eccentrically mounted underreamers can be diverted off-axis if the underreamer encounters rock fragments, buried metal objects, etc. Any diversion of a large drill bit is unacceptable in most drilling operations, and particularly where a series of closely spaced holes are being formed.

The installation of casing in a drilled ground hole is also greatly hindered by any such diversion.

Other known underreaming equipment utilizes three bit mounted plates which are outwardly displaceable, but which incorporate a total working surface which is substantially less than the perimeter of the bore. Such undersized plates are subject to excessive wear and result in slow drilling operation.

Underreaming can also be achieved by use of a crown or ring bit, but components of those bits must be left in the underreamed area when drilling is complete, which is costly and otherwise unacceptable in some drilling operations.

Each of these problems is addressed by my co-pending U.S. application Ser. No. 08/674,123, and by the additional related underreamer embodiments disclosed and claimed below.

In addition to the foregoing problems associated with known underreamers, quick and efficient removal of drilling debris from the hole and drilling bits remains a problem. In my U.S. Pat. No. 5,511,628, which is hereby expressly incorporated by reference into this application, I disclosed a pneumatic down-hole drill with a central evacuation outlet. The apparatus of U.S. '628 permits continuous evacuation of large debris fragments through a central axial bore formed in the bit and through a central evacuation tube attached thereto. Compressed air is directed downwardly through peripheral channels, under the drill bit, and into a central evacuation tube. The flow of compressed air through the central evacuation tube provides continuous and efficient removal of earthen fragments from the bore, including rapid removal of fragments that would be too large for removal through peripheral pathways along the casing.

However, a need remains for a reverse circulation pneumatic drill which provides for underreaming of the bore, continuous evacuation of drilling debris fragments from the drilling face in the bore, and for ready removal of the drill bit through the casing during or after completion of the drilling operation.

SUMMARY OF THE INVENTION

The present invention is embodied in a reverse circulation system that addresses the shortcomings of the prior art.

It is therefore an object of the invention to provide an underreamer that includes a pilot bit on which are mounted underreamer arms which can be extended and retracted by relative rotation between the pilot bit and the underreamer arms. Each underreamer arm includes a strengthening boss. The strengthening boss includes axial bearing surfaces that engage corresponding axial surfaces of the pilot bit. The bearing surfaces of the arm bosses and the bits include surfaces shaped to extend the arms as the pilot bit is rotated relative to the pilot bit. Surfaces are also provided for locking the arm in its extended underreaming position. As the bit is rotated in the opposite direction, the locking surfaces disengage and the arm can be retracted without vertical movement of the driver.

In another aspect of the invention, provision is made to continually flush the bit with compressed air which is exhausted from the down hole hammer. The flow of exhaust air is routed through porting in the bit assembly into the central evacuation tube. A second flow of compressed air may also be provided to continually flush the perimeter region of the bit. In one embodiment, the perimeter flushing air is received from compressed air introduced at the wellhead to pressurize the casing.

These and other aspects of the invention will be described in further detail with reference to the drawings.

BRIEF DESCRIPTION OF THE DRAWINGS

FIG. 17 is an enlarged partial view of the bit driver and underreamer arm shown in FIG. 13.

FIG. 18 is a partial cutaway bottom view of the bit assembly depicted in FIGS. 11–17 showing the compressed air flow path.

DETAILED DESCRIPTION

Figure 1:
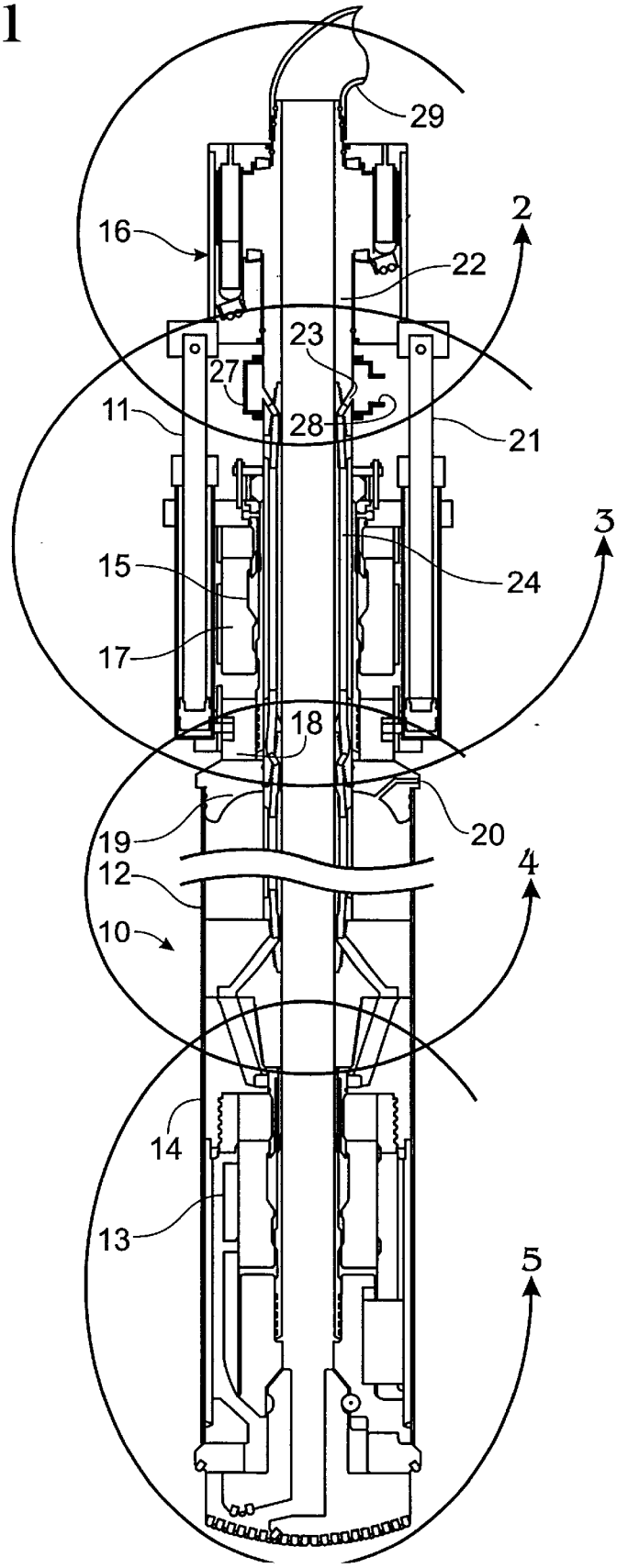
FIG. 1 is a partial cross-sectional view of a drilling assembly according to the present invention.
Figure 2:
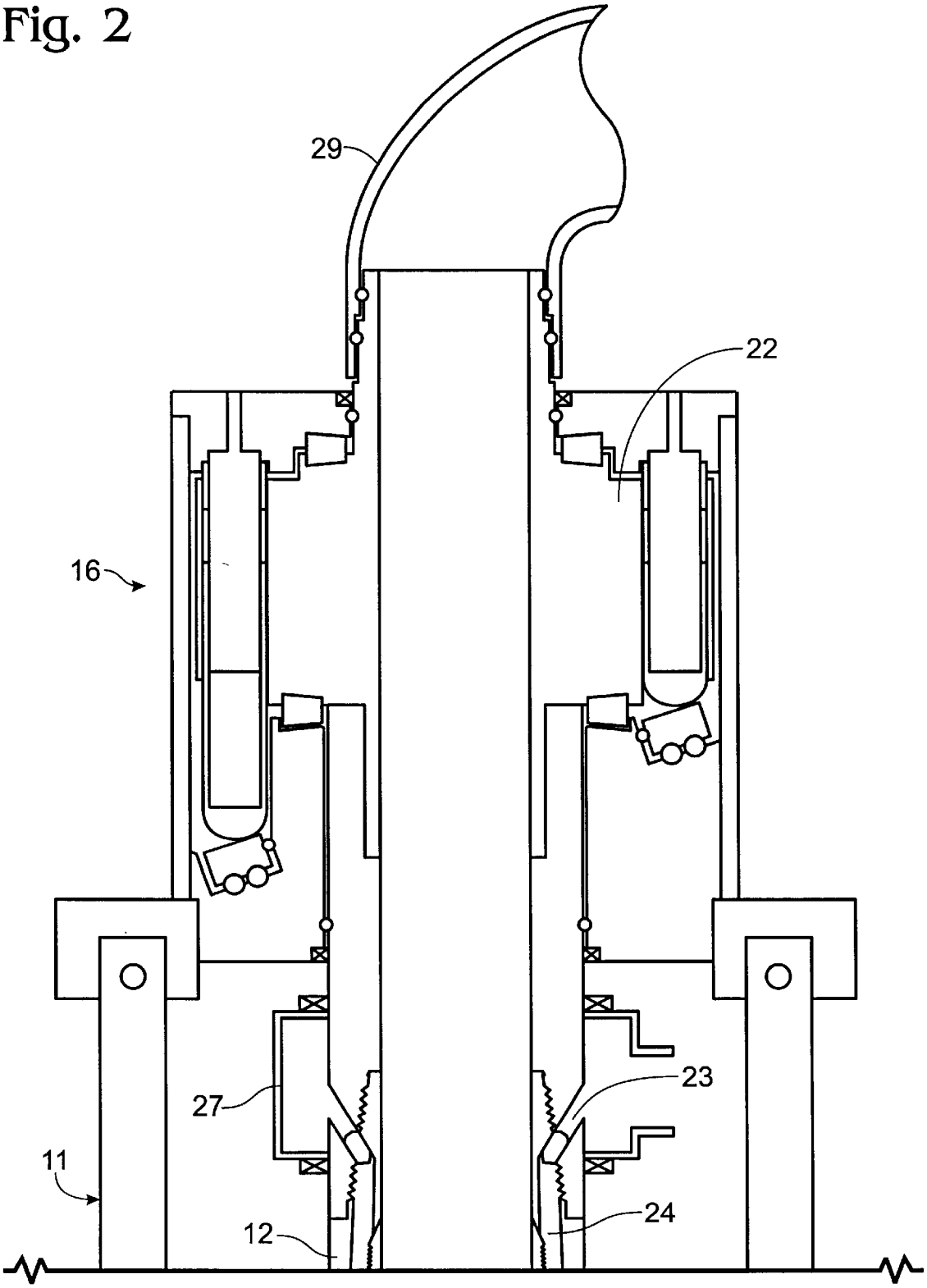
FIG. 2 is an expanded partial cross-sectional view of the assembly shown in FIG. 1, showing the power head assembly, compressed air inlet collar, and the upper terminus of the dual wall pipe assembly.
Figure 3:
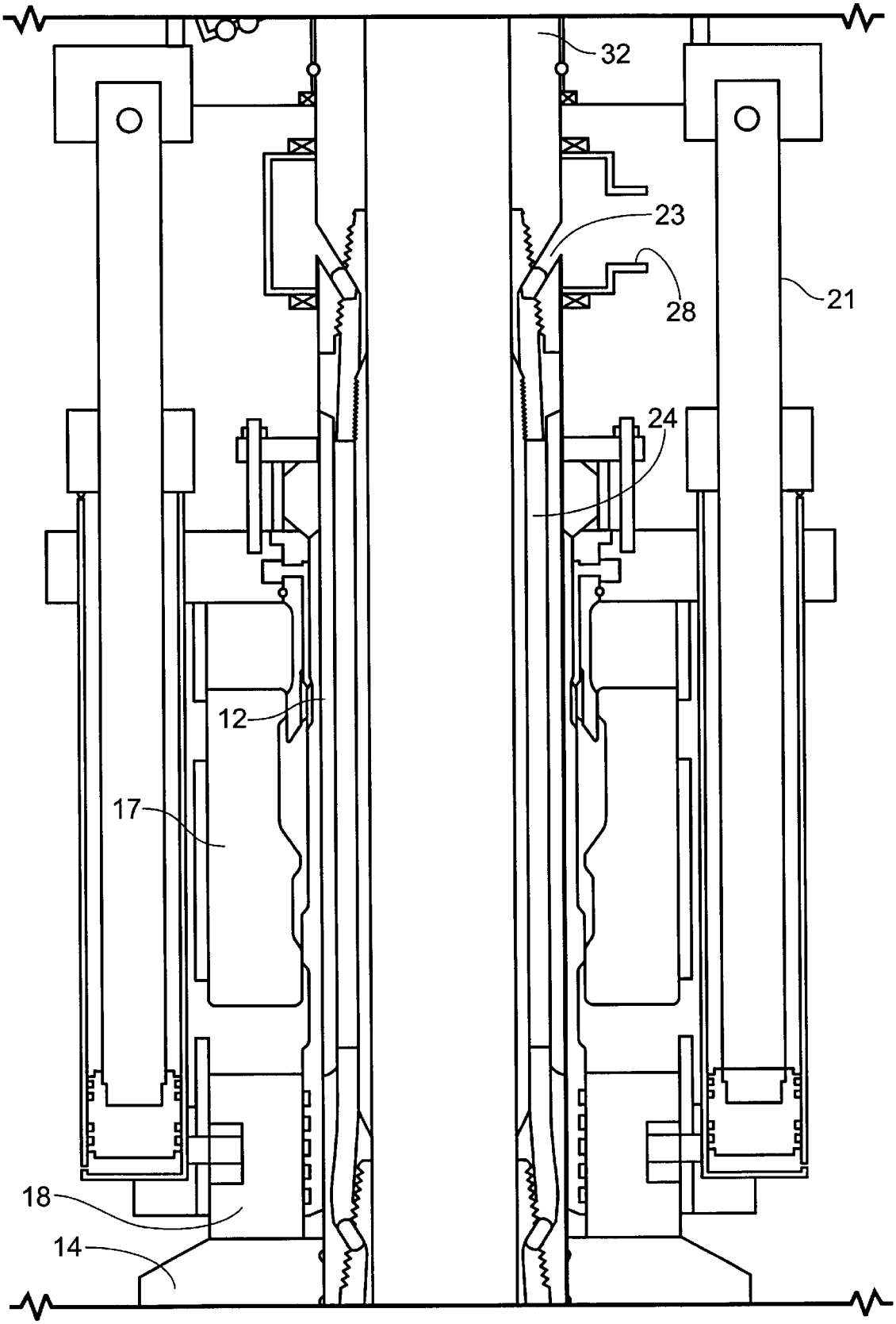
FIG. 3 is an expanded cross-sectional view of the assembly shown in FIG. 1, showing the casing driver in greater detail.

Referring now to FIG. 1, a reverse circulation drilling system, shown generally at 10, includes a head assembly 11, a dual wall pipe assembly 12, and a down hole pneumatic hammer 13 within a bore casing 14. Turning to FIGS. 2 and 3, head assembly 11 includes a casing driver 15 for driving the bore casing 14 downwardly as the bit advances, and a power head assembly 16 of standard design for rotating the bore casing 14 it is driven downwardly. Casing driver 15 includes an annular hammer 17 which reciprocates vertically as compressed air is alternatively admitted to chambers above and below hammer 17. Hammer 17 impacts on anvil 18, which in turn impacts on casing cap 19. Casing cap 19 is sealed against the inner surface of bore casing 14 to permit pressurization, through port 20, of bore casing 14 between casing cap 19 and down hole hammer assembly 13. Pressurization of the casing provides a downward flow of air between the casing and the down hole hammer, preventing upward migration of debris between the down hole hammer and casing, which can hinder the removal of the hammer.

In locations where there is a concern about the stability of the formation being drilled, use of a pressurizing fluid other than air is preferred. The alternative pressurizing fluid in such instances can be water, drilling mud, a polymeric liquid, or another substantially non-compressible fluid. When a non-compressible fluid is used to pressurize the casing, a portion of the fluid is discharged into the lower portion of the bore, and supports the surrounding formation, reducing the likelihood of the bore collapsing.

Power head assembly 16 is connected to anvil 18 through linkage assembly 21 to impart rotation to the dual pipe assembly and the down hole hammer. Power head assembly 16 is of a design generally known in the field, other than its central member 22, that is threaded onto the upper end of dual wall pipe assembly 14, includes a central bore in communication with the dual wall pipe assembly to extend the debris discharge path through the power head to the elbow 29. The joint of central member 22 and the dual wall pipe 14 includes a port 23 for admitting air to the annulus 24 between the inner wall 25 and the outer wall 26 of the dual wall pipe assembly. Collar 27 is mounted around the joint, and includes air inlet 28, through which compressed air is admitted into the dual wall pipe assembly for driving the down hole hammer as further described below. An elbow 29 is rotatably mounted and sealed to the upper end of central member 22. Elbow 29, central member 22 and the inner wall 25 of dual wall pipe assembly 14 together form a central drilling debris discharge tube for continuously discharging drilling debris from the down hole hammer as will also be described more fully below.

Figure 4:
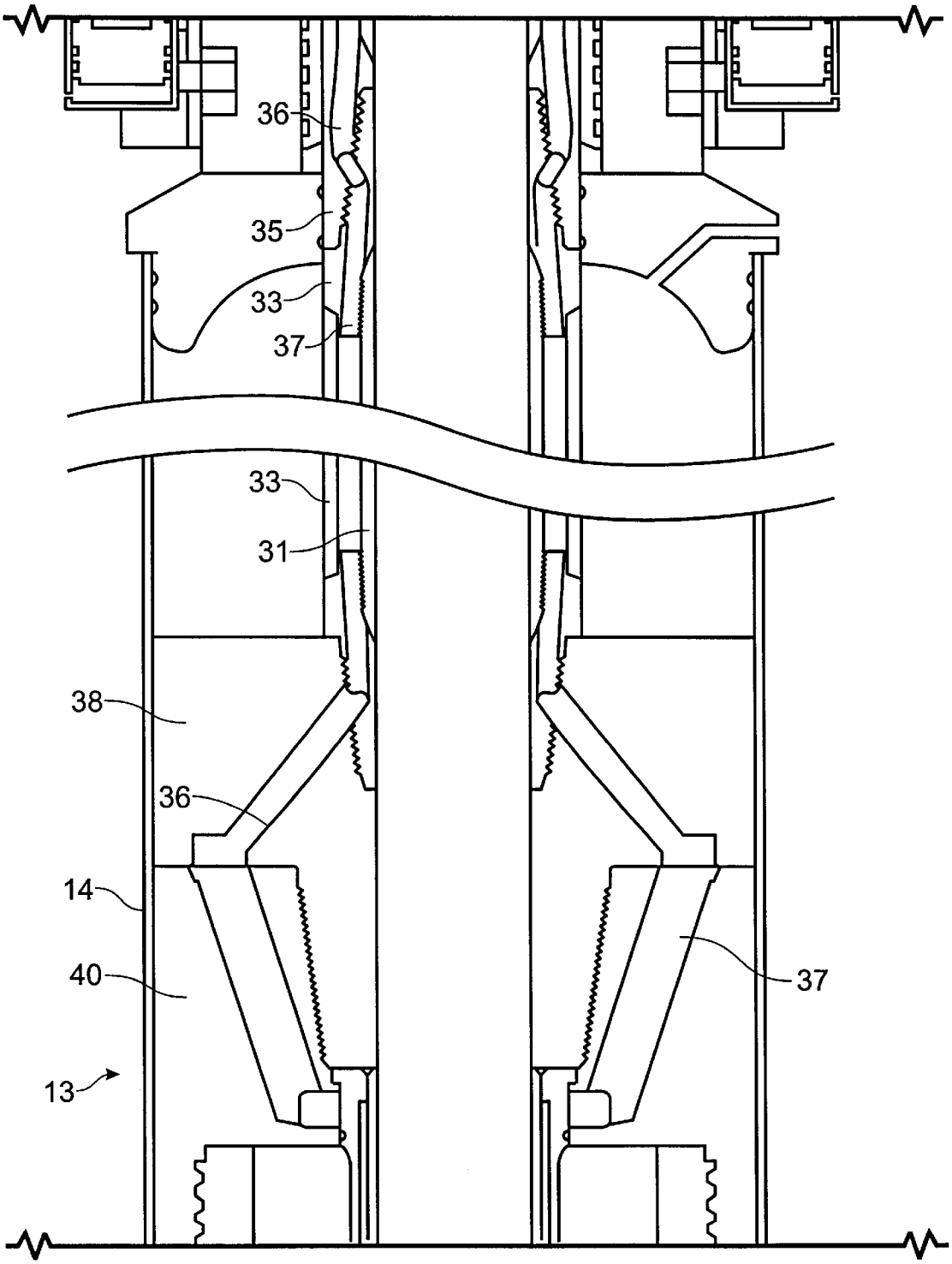
FIG. 4 is an expanded cross-sectional view of assembly shown in FIG. 1, showing the dual wall pipe assembly and the box and back head assembly connecting the lower terminus of the dual wall pipe assembly to the down-hole pneumatic hammer.

Turning also to FIG. 4, dual wall pipe assembly 12 is assembled from individual segments, each of which includes an inner pipe 31 and an outer pipe 33. Each segment includes a threaded male connector 33 and a threaded female connector 35 at opposite ends. Male connector 14 and female connector 15 each includes air ports 36 and 37 respectively which are in communication with outer annulus 24 of dual wall pipe assembly 11. At its upper end, dual wall pipe assembly is threaded in to central member 22 of power head 16. At its lower end, dual wall pipe assembly 11 is connected to the box 38, which in turn is threaded into back head 40 of down-hole hammer 13. Ports 42 an 44 communicate with annulus 24 of the dual wall pipe assembly to route compressed air therefrom into the down hole hammer.

Figure 5:
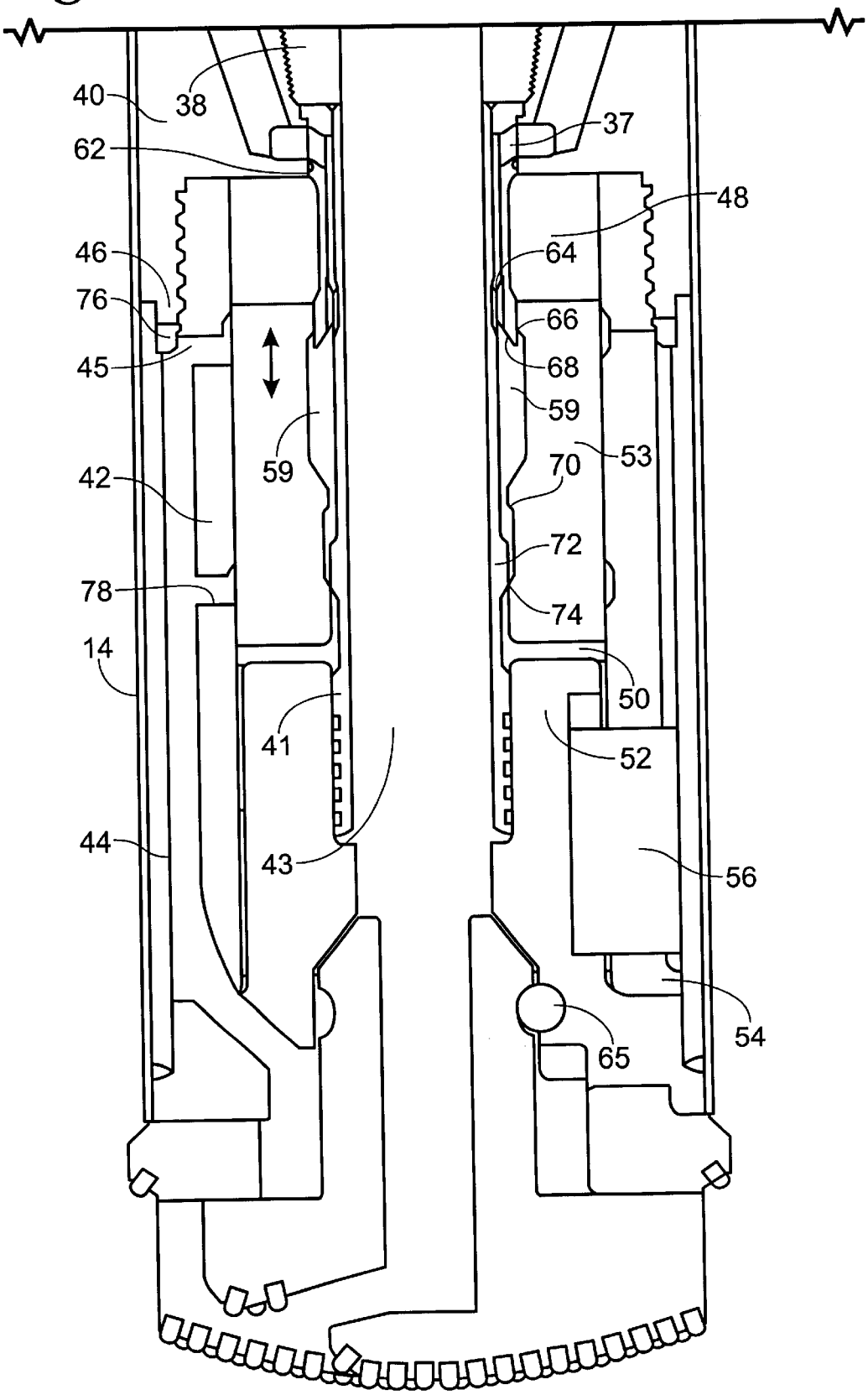
FIG. 5 is a cross-sectional view of the down-hole pneumatic hammer assembly, including the bit assembly.

Turning now to FIG. 5, down-hole hammer 13 includes box 38 threaded onto back head 40. A sleeve 41 and a hammer barrel 42 are threaded into back head 40. A centrally located discharge tube 43 is pressed into sleeve 41. A wear sleeve 44 is fitted around hammer barrel 40, and press fitted over ring 45 and onto shoulder 46 of back head 40. Sleeve 41 and barrel 42 define an annular upper air chamber 48. Central evacuation tube 43 and barrel 42 define an annular lower air chamber 50. The lower end of barrel 42 abuts bit driver 52, and also includes a perimetrical lip 54 which engages wear sleeve 44 to center barrel 42 in the wear sleeve. Hammer 53 is slidingly fitted into barrel 42 for reciprocation. Bit driver 52 is slidably fitted into barrel 42 below hammer 53, and over the lower end of central evacuation tube 43. Bit driver 52 is retained in barrel 42 by a plurality of keys 56, each of which is fitted into a keyway 58 and annular recess 60 of bit driver 52. (See also applicant's U.S. Pat. No. 5,511,628, incorporated by reference above, for detail of an alternate barrel assembly incorporating a like key and keyway assembly for mounting the bit driver in the hammer barrel.) The key-keyway assembly permits the bit assembly to advance ahead of the dual wall pipe assembly during drilling.

Figure 7A:
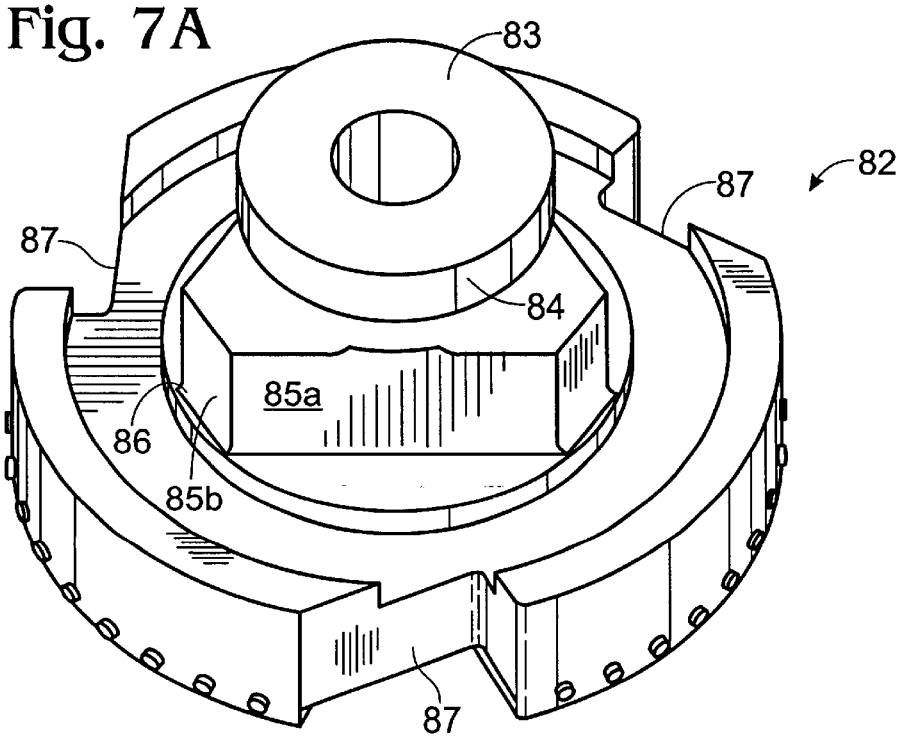
FIG. 7A is a perspective view of the pilot bit on the embodiment of FIG. 6A.
Figure 6A:
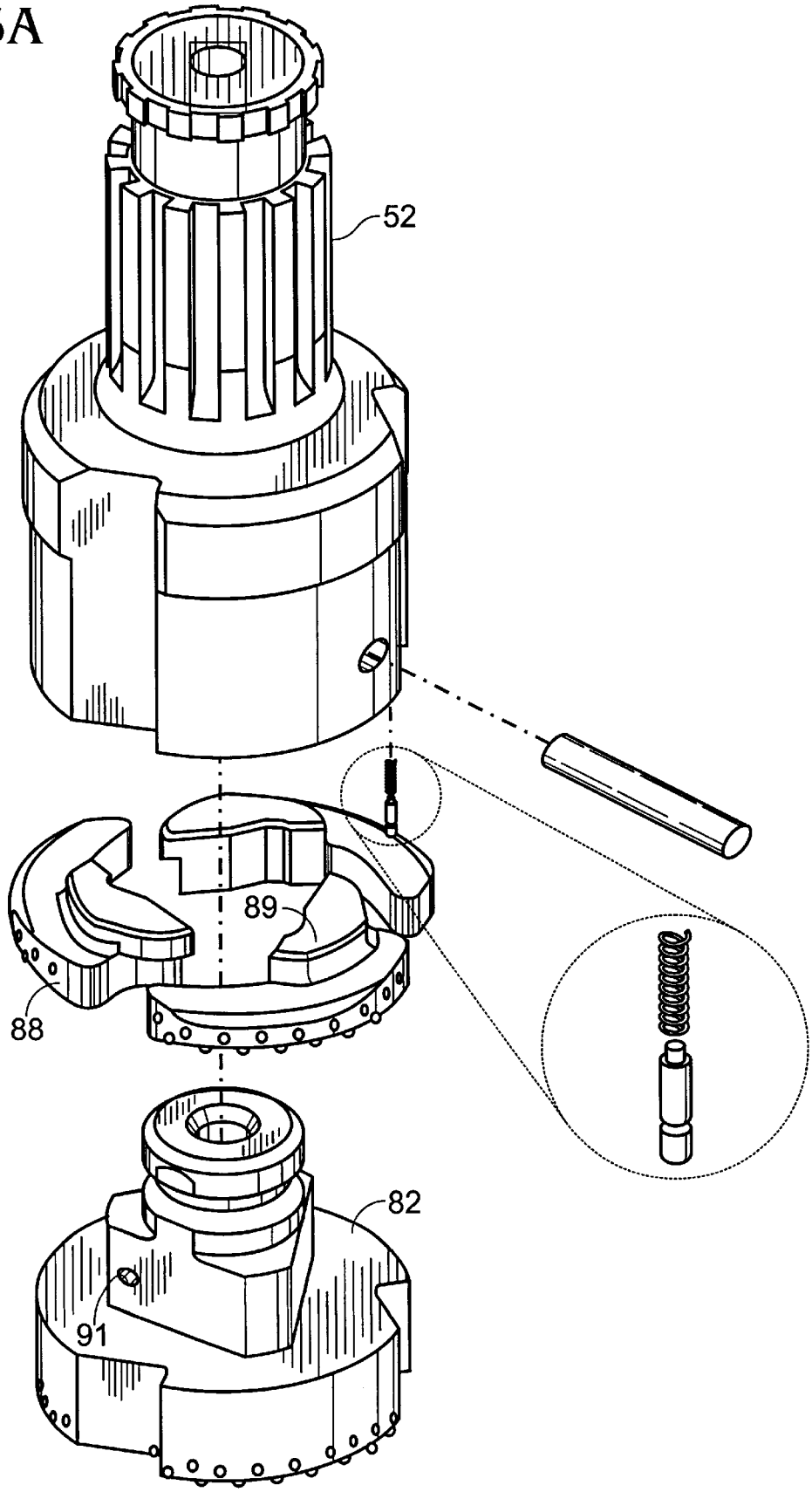
FIG. 6A is an exploded perspective view of a first embodiment of a bit assembly according to the present invention.
Figure 6B:
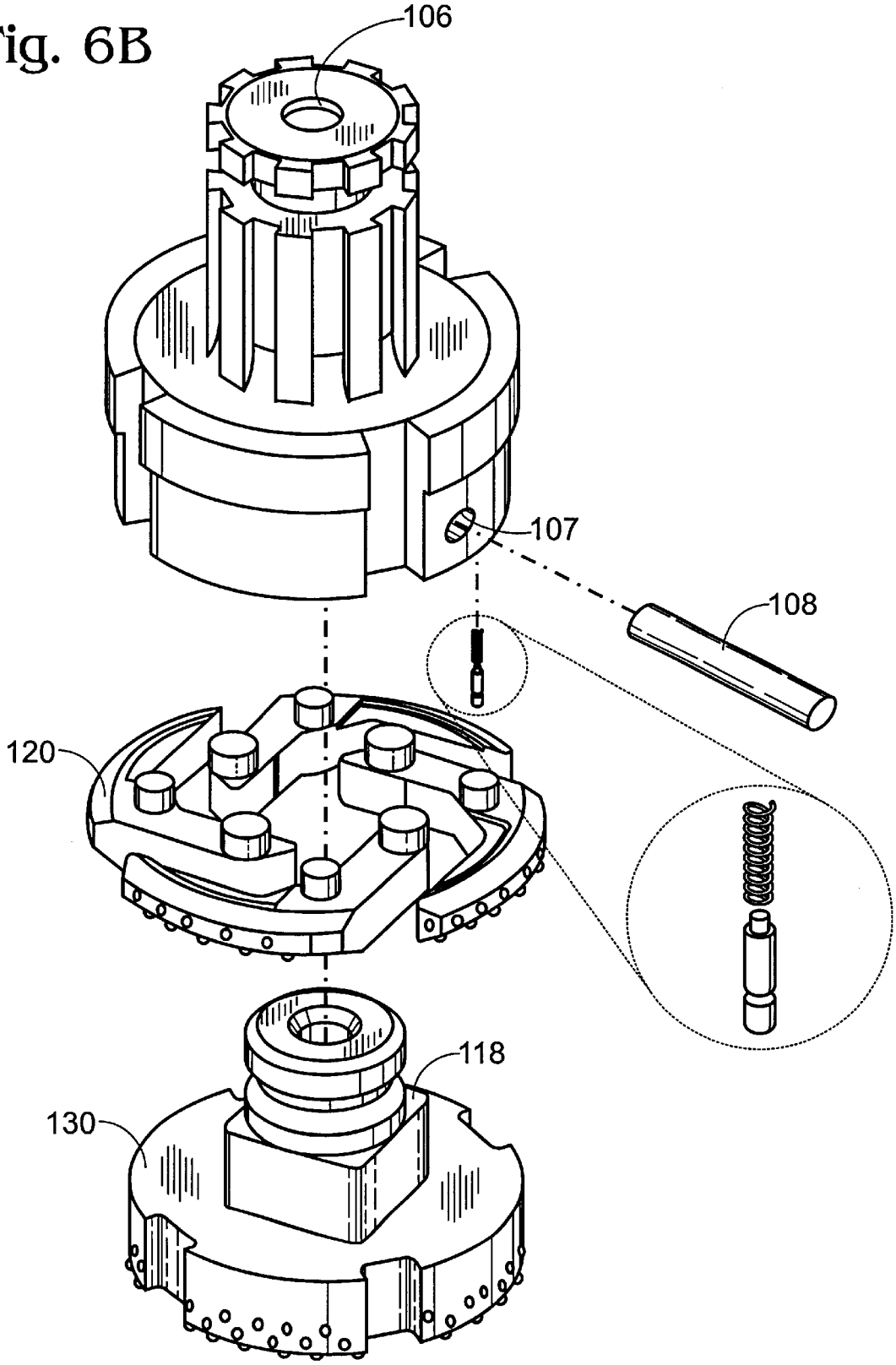
Figure 7B:
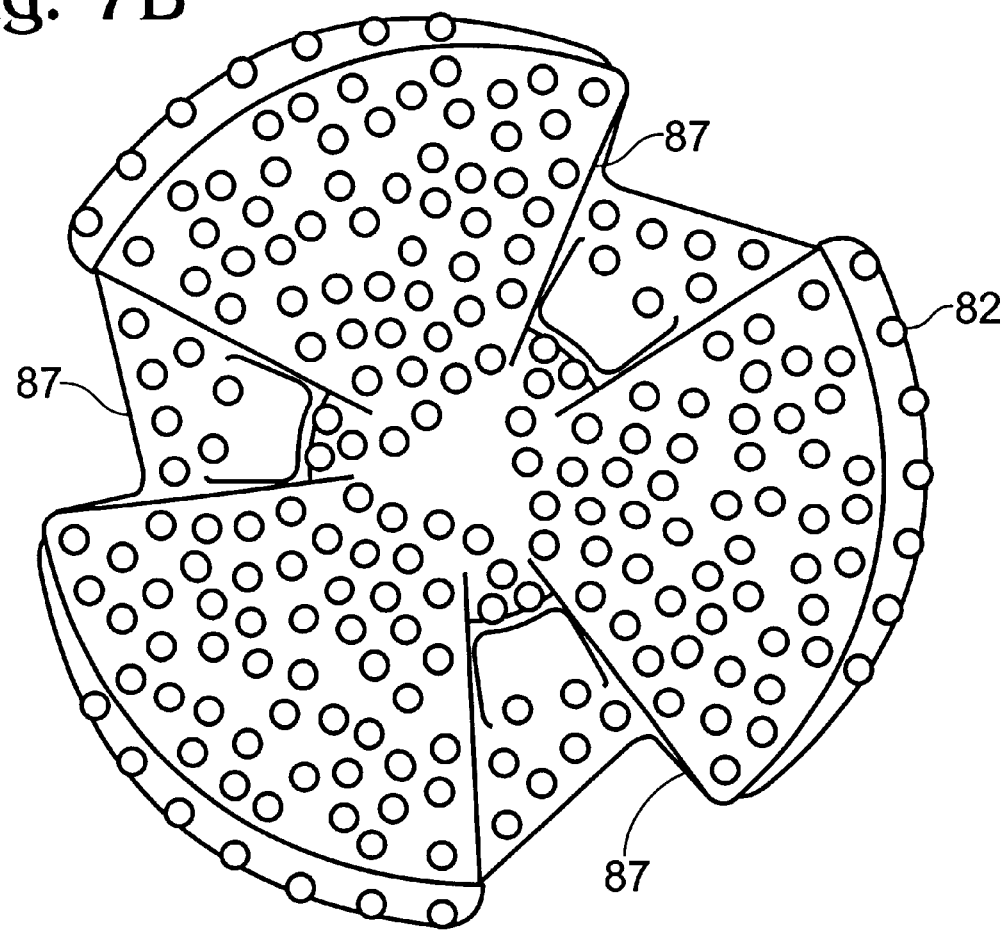
FIG. 7B is a bottom view of the pilot bit shown in FIG. 7A.
Figure 8:
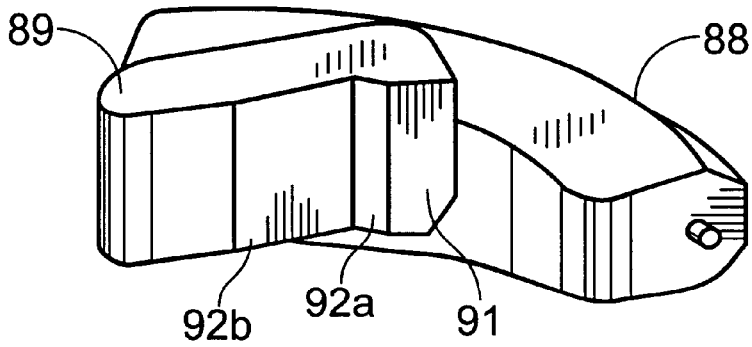
FIG. 8 is a perspective view of an underreamer arm used in the embodiment shown in FIG. 6A.
Figure 9A:
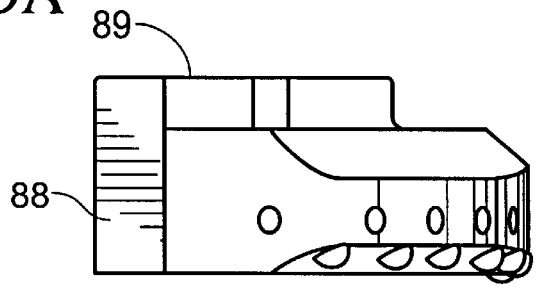
FIG. 9A is an end view of the underreamer arm shown in FIG. 8.
Figure 9B:
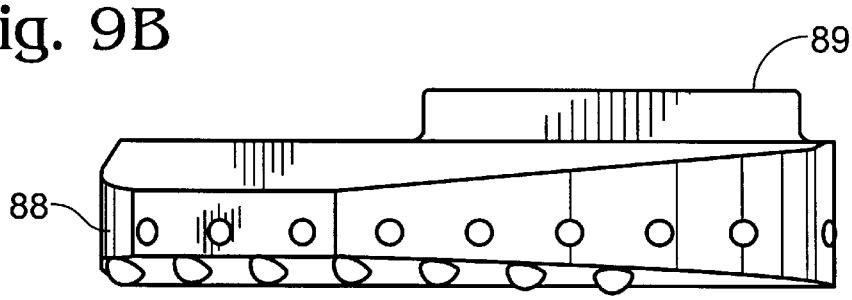
FIG. 9B is an outer side view of the underreamer arm shown in FIG. 8.
Figure 10:
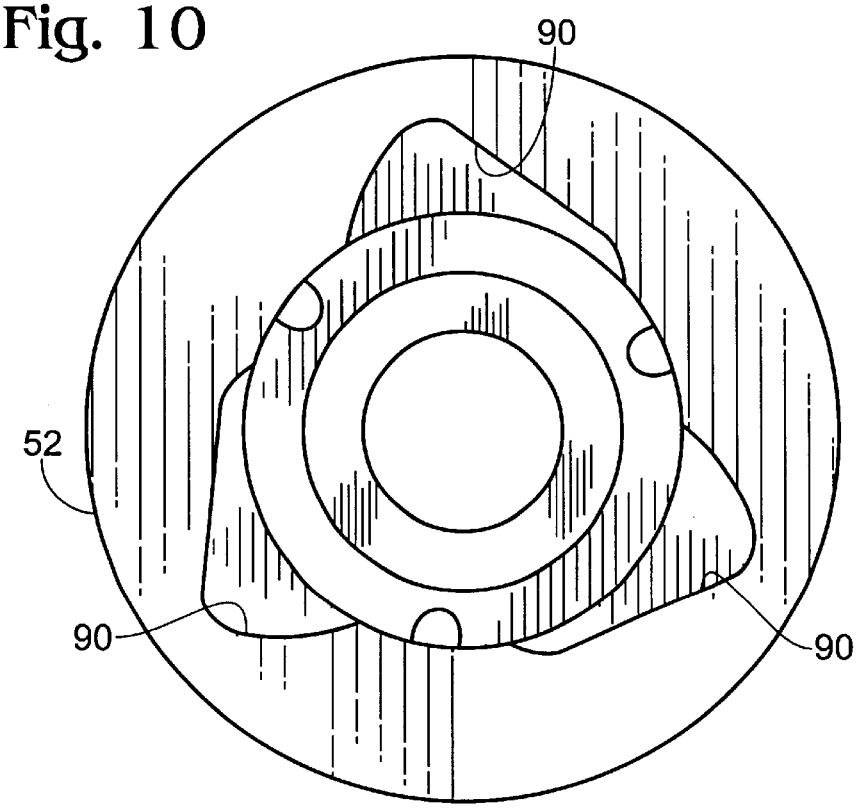
FIG. 10 is a bottom view of the bit driver of the embodiment shown in FIG. 6A, showing the axial surfaces which define the recesses which receive the underreamer arms, and the axial surfaces which bear against the underreamer arms for extension and retraction.
Figure 11:
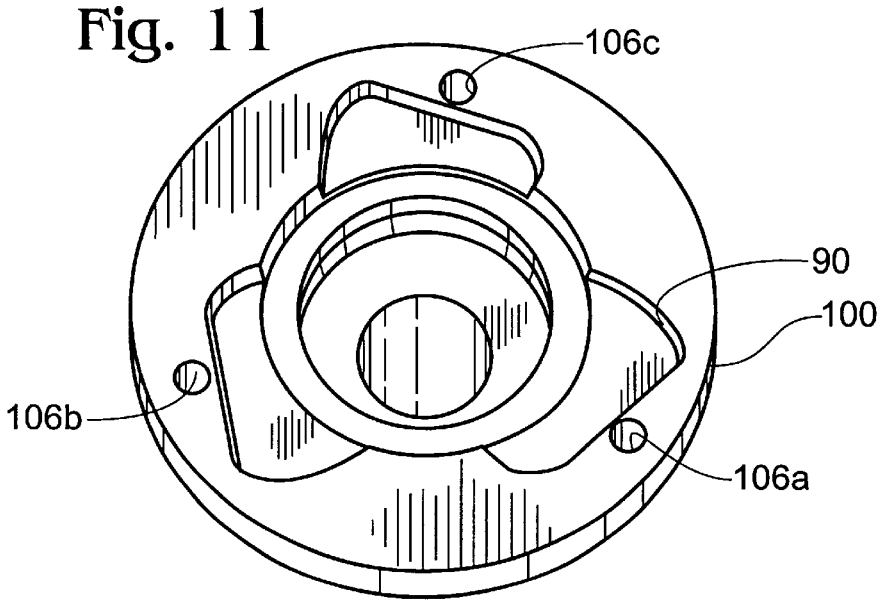
FIG. 11 is a bottom view of the bit driver in a second embodiment of the invention.

A bit assembly according to the present invention is shown in FIG. 6. Turning to FIG. 6, a bit assembly includes bit driver 52, pilot bit 82, and arms 88*a–c*. Pilot bit 82 includes an upper shank 83 having a recessed chamfer 84, camming surfaces 85*a* and 85*b*, and a lower portion 86. Lower portion 86 includes three peripheral recesses 87*a–c*. Hardened drilling buttons, preferably made of a carbide material, are mounted on the peripheral and bottom surfaces of the pilot bit (FIG. 7). Arms 88*a–c* are nested atop pilot bit 82, and slide thereon in an prescribed arcuate path as will be described. Each of the arms includes a raised boss 89 which is received into corresponding recess 90 of bit driver 52 (FIG. 10). Raised boss 89 serves several functions. First, impact forces from the hammer are transmitted downwardly to the pilot bit 82 through bit driver 52, boss 89, and arm 88. Second, boss 89 is received and retained in recess 90, where it rotates through a limited arc to extend and retract arm 88. With arm 88 in its retracted position, surface 91 is adjacent camming surface 85*a*. in this configuration, the overall diameter of the bit assembly is less than the inner diameter of the bore casing, permitting the bit assembly to be withdrawn from the bore. As arm 88 is rotated clockwise about pilot bit 82 by clockwise rotation of bit driver 52, angled surfaces 85*a* engage surface 92 and urge arm 88 outwardly. The rotation and extension of arm 88 continues until surface 92*a* abuts surface 85*b* and surface 92*b* abuts surface 85*a*, locking arm 88 in its extended position. To unlock and retract arm 88, bit driver 52 is rotated in the opposite direction. In its fully retracted position, the overall diameter of the underreamer assembly is less than the inside diameter of the casing, permitting withdrawal of the entire underreamer bit assembly through the casing if necessary. This feature represents a significant advance over known underreamers, which cannot be retracted and withdrawn through the casing if necessary.

Figure 5A:
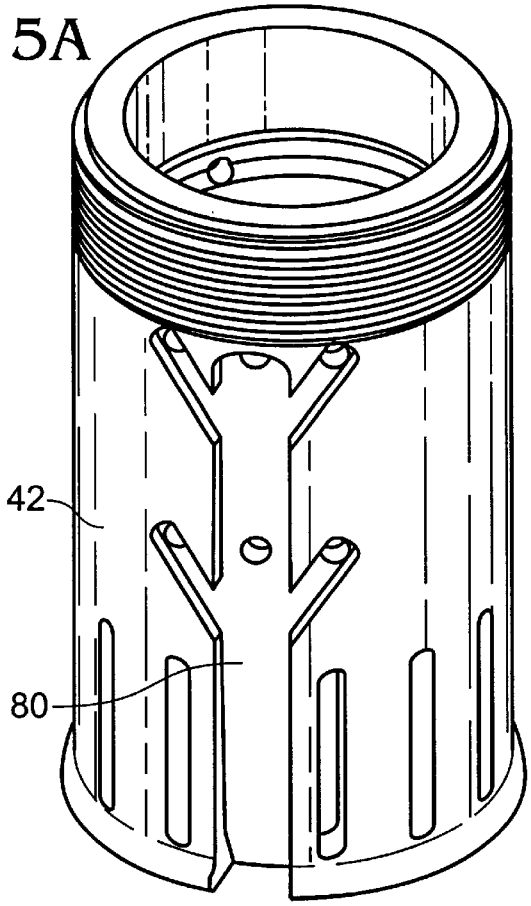
FIG. 5A is a perspective view of an alternative design for the hammer barrel of the down-hole pneumatic hammer assembly.

In operation, compressed air is delivered into annular chamber 59 through port 37, radial ports 60, annulus 62 and axial ports 64. In FIG. 5, hammer 53 is shown during its downward stroke. Lip 66 is engaged with lip 68, sealing off chamber 48. Lip 72 is engaged with lip 74, sealing off chamber 50. Port 78 is closed. As piston 53 continues downwardly, port 76 is uncovered, exhausting chamber 48. At about the same time, lip 74 disengages from lip 72, admitting a fresh charge of compressed air into chamber 50 to raise piston 53 to its upper position after it has struck bit driver 52. As piston 53 rises, port 78 is uncovered, exhausting chamber 50. Lip 74 engages lip 72, sealing chamber 50. Port 76 is sealed by piston 53, and lip 66 disengages from lip 68, admitting a fresh charge of compressed air into chamber 48. The fresh charge of compressed air in chamber 48 drives piston 53 downwardly to begin another stroke. The compressed air exhausted into ports 76 and 78 is collected in port 80 (FIG. 5A), and discharged through the bit assembly into central evacuation tube 43, carrying with it drilling debris and earthen fragments dislodged by the bit. As an added precaution against drilling debris becoming lodged between arms 88*a–c* and the pilot bit, in the bit assembly embodiment shown in FIG. 6B, port 91 is provided through which compressed air can be discharged to clear debris. The flow of compressed air through the bit assembly is essentially continuous, and provides a continuous evacuation of drilling debris from the drilling face of the bore. Moreover, the essentially constant diameter of the evacuation tube and inner wall of the dual wall pipe assembly provides a constant air velocity, which further aids debris removal. The continuous removal of debris through the central evacuation tube promotes continuous drilling. It is seldom, if ever necessary to stop drilling and raise the bit to clear debris from the bore. Significant improvements in drilling rates directly result. In addition, since debris is quickly removed as it is dislodged, it is possible to obtain a relatively accurate "core" sample from the bore. This aspect of the invention is useful in both exploratory and environmental applications.

In another aspect of the invention, pilot bit 104 advances into the ground with the underreamer arms locked in a deployed position below and radially beyond the advancing end of the casing at C. Casing movement is facilitated by the relatively large underreamed area, and if required, by the casing driver 15. In one embodiment shown in FIGS. 1 and 3, if the drill bit assembly advances more than a predetermined distance ahead of the casing, linkage 21 operates a valve to provide compressed air to the pneumatic hammer 17 and associated porting casing driver 15.

Figure 12:
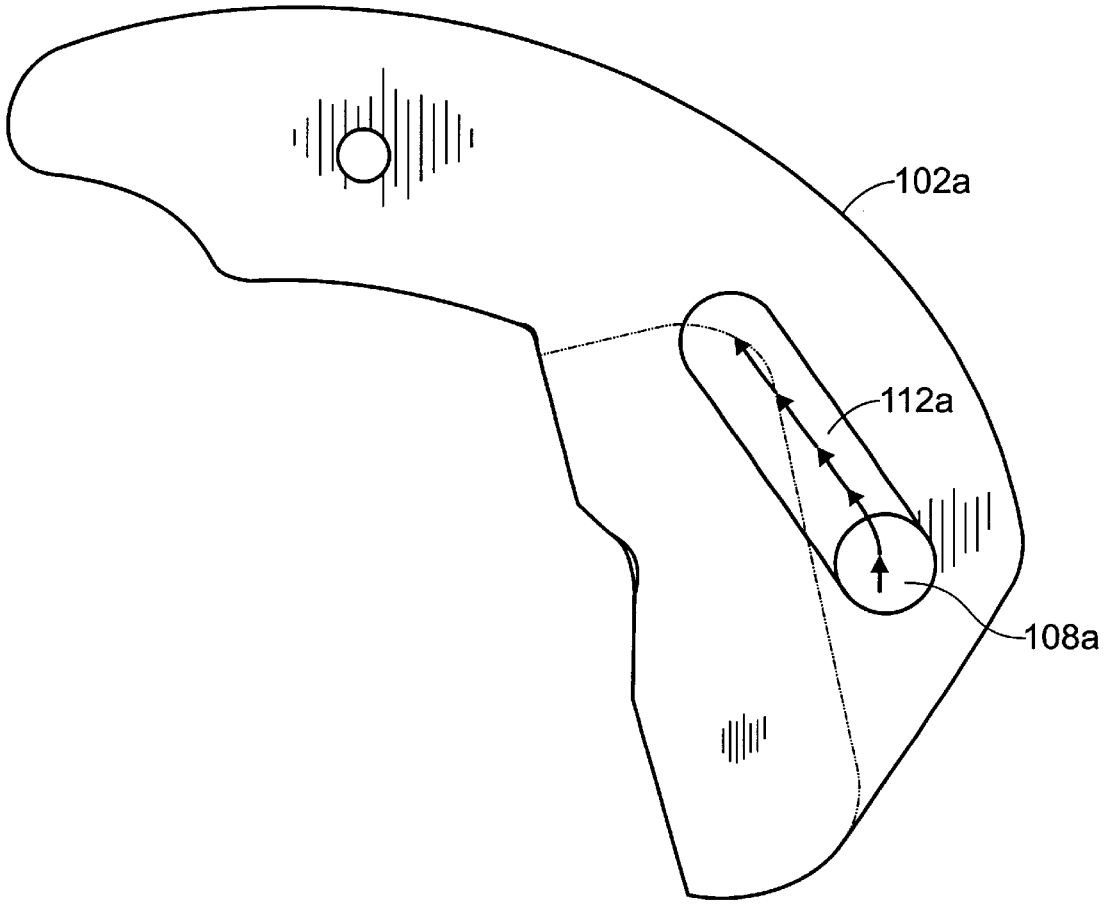
FIG. 12 is a bottom view of an underreamer arm of the embodiment referred to in FIG. 11.
Figure 13:
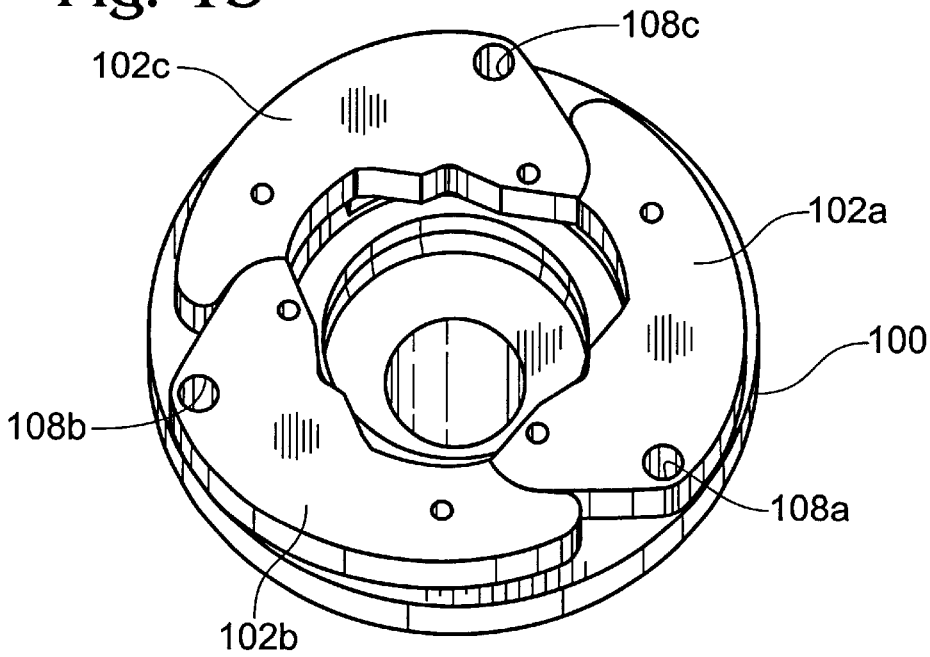
FIG. 13 is a bottom view of the arms depicted in FIG. 12 mounted in their retracted position on the bit driver shown in FIG. 11.
Figure 14:
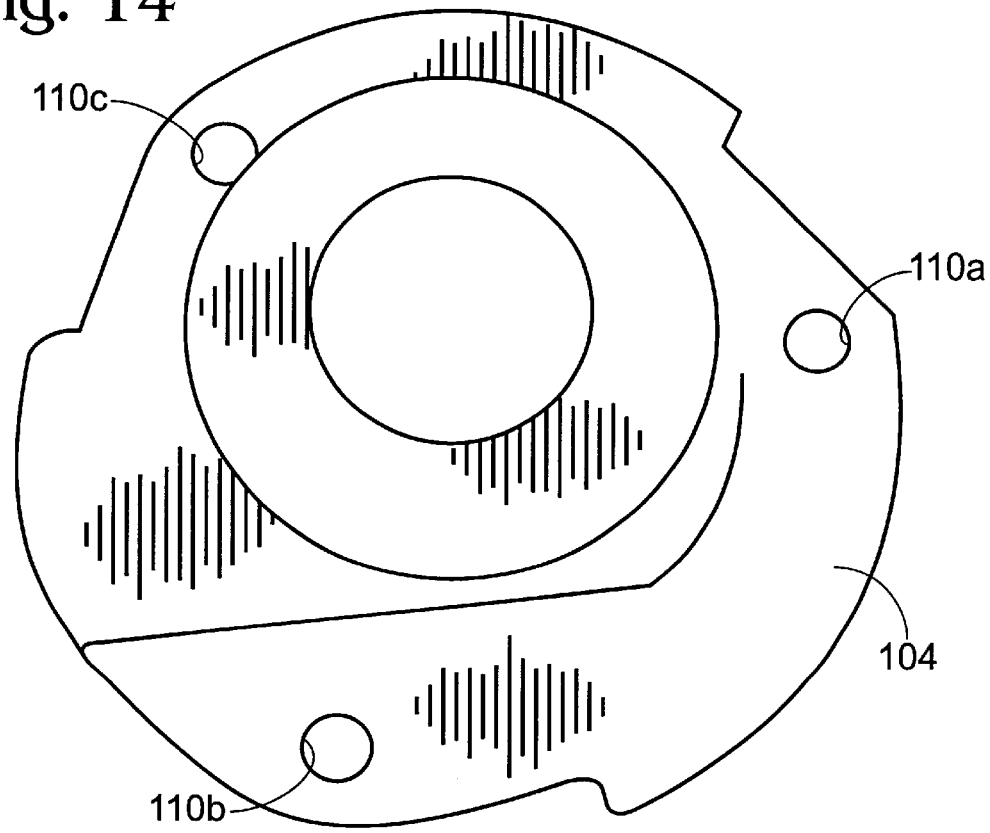
FIG. 14 is a top view of a pilot bit for use with the bit driver and underreamer arms depicted in FIG. 13.
Figure 15:
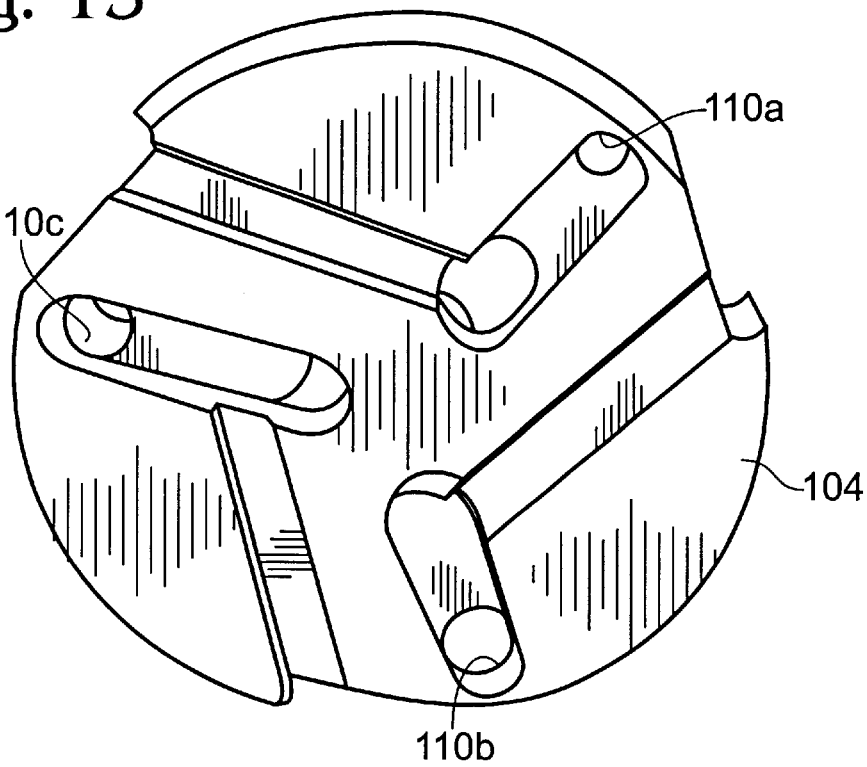
FIG. 15 is a bottom view of the pilot bit depicted in FIG. 14.
Figure 16:
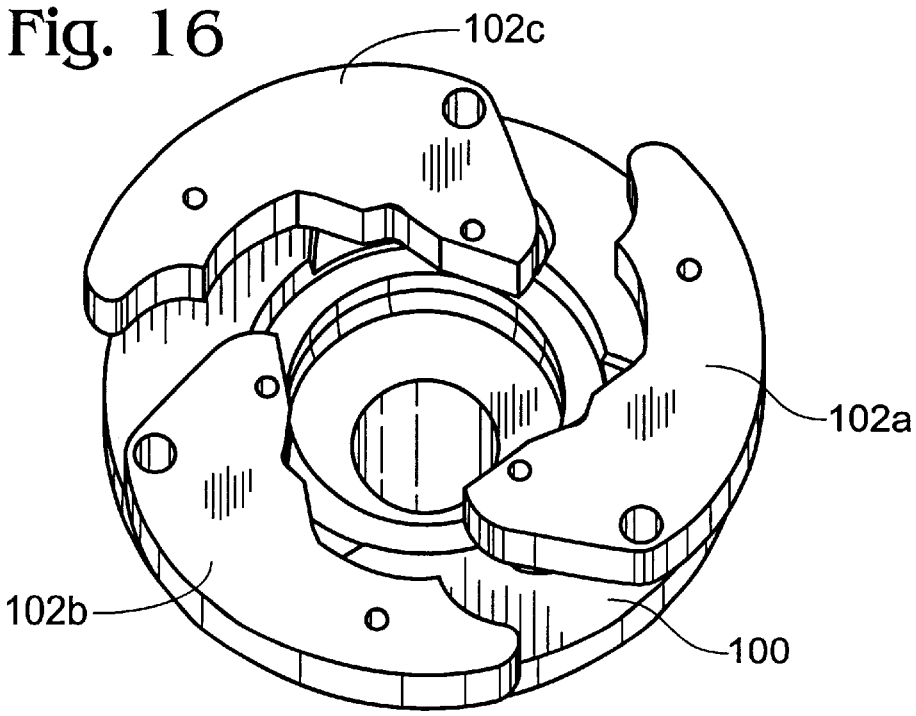
FIG. 16 is the bit driver and underreamer arms shown in FIG. 13 with the underreamer arms in their extended positions.

An alternative embodiment of the invention will now be described with reference to FIGS. 11–19. In this embodiment, the bit assembly also includes a bit driver 100, arms 102*a–c*, and pilot bit 104, which are fitted together as described in the previous embodiment shown in FIG. 6. In this embodiment, however, compressed exhaust air from port 80 is routed through internal ports in the bit driver, arms and pilot bit. Referring to FIG. 1, hammer exhaust air from port 80 flows into and through bit driver 100 via ports 106*a–c*. The hammer exhaust air then flows through ports 108*a–c* formed in arms 102*a–c* respectively (FIG. 12). In FIG. 13, the arms are shown mounted on the bit driver in their closed and retracted positions. Exhaust air from ports 108*a–c* flows into ports 110*a–c* in pilot bit 104 (FIGS. 14, 15), through channels 112*a–c*, ports 114*a–c*, and into central evacuation tube 43 (FIG. 5). Ports 106*a–c*, 108*a–c* and 110*a–c* respectively are located so that they are all aligned when arms 102*a–c* are extended; i.e., holes 106*a*, 108*a* and 110*a* are aligned, holes 106*b*, 108*b* and 110*b* are aligned, and holes 106*c*, 108*c* and 110*c* are aligned. Referring to FIGS. 16 and 17, when driver 100 is rotated relative to pilot bit 104 to position arms 102*a–c* in their closed, retracted positions, ports 108*a–c* (through arms 102*a–c* respectively) are partially offset from ports 106*a–c* respectively; ports 110*a–c* (through the pilot bit) are offset from ports 108*a–c* (through the pilot bit) are entirely offset. To provide for a continuous flow of air through ports 106*a–c*, 108*a–c* and 110*a–c* when the arms are retracted, channels 112*a–c* are provided in the underside of arms 102*a–c*. Turning again to FIG. 15, pilot bit 104 also includes axial recesses 114*a–c*, and transverse channels 116*a–c*. Recesses 114*a–c* and channels 116*a–c* provide a path for the discharge of compressed air from outside the bore casing to also be discharged through central evacuation tube 43.

The foregoing description of the invention is intended to be illustrative rather than exhaustive. Those skilled in the art will appreciate that numerous changes in detail are possible without departing from the scope of the following claims.

What is claimed is:

1. A drill bit assembly for use with a down hole pneumatic hammer, comprising:

a driver;

a pilot bit having a shank, a peripheral drilling surface, a lower surface, and a bore extending from the lower surface generally upwardly through the shank;

coupling means rotatably coupling the driver to the pilot bit;

underreamer arms rotatably mounted intermediate the driver and the pilot bit and including underreaming surfaces positionable outside the pilot bit perimeter;

cam surfaces engageable with corresponding surfaces on the underreamer arms for deployment of the underreaming arms into an extended position, for locking the underreaming arms into the extended position, and for retracting the underreamer arms from the extended position by rotational movement between said driver and said pilot bit; and surfaces defining at least one air passageway between an outer surface of the driver and the bore in the pilot bit.

2. The drill bit assembly of claim 1 wherein the at least one passageway includes a passageway between each said arm and its corresponding cam surfaces.

3. The drill bit assembly of claim 2 wherein the passageway is in communication with a source of compressed fluid.

4. The drill bit assembly of claim 3 wherein the compressed fluid comprises compressed air.

5. The drill bit assembly of claim 4 wherein the compressed air comprises compressed air exhausted from a first pneumatic hammer operably connected to the drill bit assembly.

6. The drill bit assembly of claim 1 which further comprises surfaces defining at least one fluid passageway in communication with a source of compressed fluid and at least one said cam surface, the passageway including a valve operable to discharge compressed fluid through said at least one cam surface.

7. The drill bit assembly of claim 1 which further comprises:

a well casing in which is disposed the first pneumatic hammer;

a casing driver operatively connected to the well casing.

8. The drill bit assembly of claim 7 in which the casing driver includes a second pneumatic hammer, a source of compressed air operatively connected to the second pneumatic hammer.

9. The drill bit assembly of claim 8 which further comprises a valve operatively connected to the second pneumatic hammer and the source of compressed air.

10. The drill bit assembly of claim 9 wherein the valve admits compressed air to the second pneumatic hammer responsive to a predetermined vertical offset between the bit driver and a lower end of the well casing.

11. The drill bit assembly of claim 1 wherein the surfaces defining at least one air passageway between an outer surface of the driver and the bore in the pilot bit include at least one port through each of the driver, the underreamer arms and the pilot bit.

12. The drill bit assembly of claim 11 wherein the surfaces defining at least one air passageway between an outer surface of the driver and the bore in the pilot bit further include a channel in communication with the at least one port through each of the underreamer arms and the port through the pilot bit.

* * * * *